United States Patent [19]

Flinn, Jr.

[11] Patent Number: 4,739,991

[45] Date of Patent: Apr. 26, 1988

[54] HEAD POSITIONING AID

[75] Inventor: Henry I. Flinn, Jr., Pittsboro, N.C.

[73] Assignee: Mary C. Flinn, Pittsboro, N.C. ; a part interest

[21] Appl. No.: 10,342

[22] Filed: Feb. 3, 1987

[51] Int. Cl.[4] ..... A63B 69/36

[52] U.S. Cl. ..... 273/183 B; 40/329; 2/195; 273/183 E

[58] Field of Search ..... 2/199, 195, 175, 177; 273/183 B, 190 R, 190 A, 183 E; 40/329; D2/244, 245, 246, 247, 248; 351/44, 45, 53, 158

[56] References Cited

U.S. PATENT DOCUMENTS

| | | | |
|---|---|---|---|
| 1,538,847 | 5/1925 | Wheeler | 40/329 |
| 2,330,442 | 9/1943 | Nero | 273/190 A |
| 2,431,169 | 11/1947 | Dice | 40/329 |
| 2,440,878 | 5/1948 | Schneider | 273/183 B |
| 2,663,021 | 12/1953 | Douglass | 273/190 A |
| 4,531,743 | 7/1985 | Lott | 273/183 B |
| 4,630,317 | 12/1986 | Brown et al. | 2/199 |

FOREIGN PATENT DOCUMENTS

| | | | |
|---|---|---|---|
| 1373772 | 11/1974 | United Kingdom | 273/183 B |

*Primary Examiner*—George J. Marlo

*Attorney, Agent, or Firm*—Cushman, Darby & Cushman

[57] ABSTRACT

An aid for positioning a user's head with respect to a remote object is described. The device comprises a visor, having front and back edges, the visor being attached at its back edge to a headpiece. A pair of spaced line markings are provided on the underside of the visor, the markings being located substantially equidistant from an axis extending between the front and back edges and bisecting the visor. The distance between the markings closest to the back edge of the visor substantially corresponds to the distance between the eyes of the user.

6 Claims, 2 Drawing Sheets

Fig. 1.
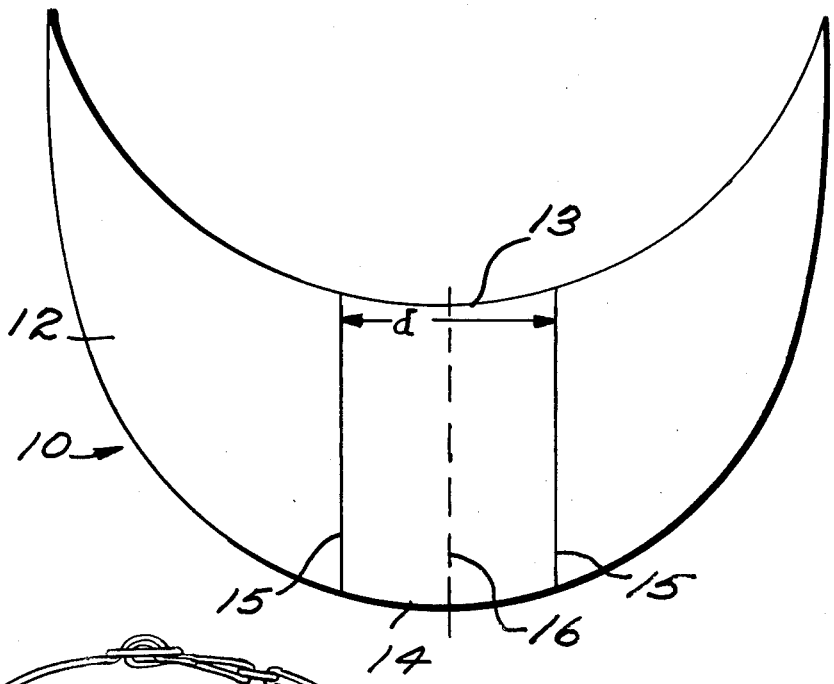
Fig. 2.
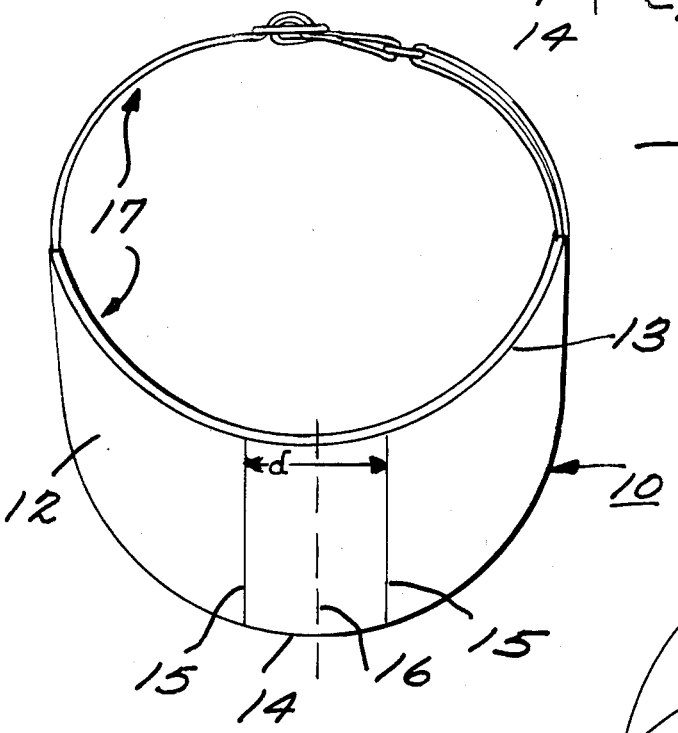
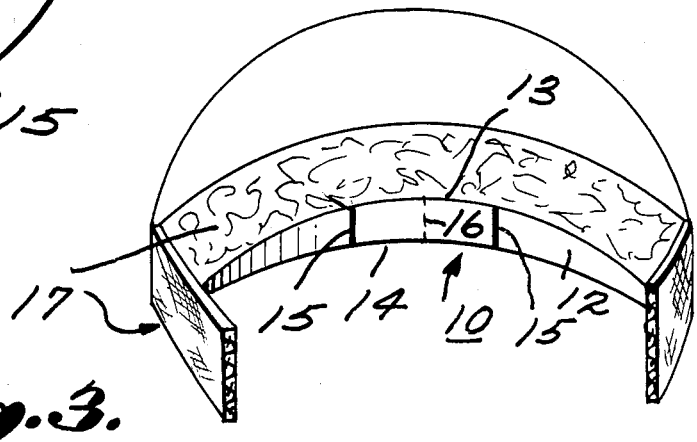
Fig. 3.

HEAD POSITIONING AID

BACKGROUND OF THE INVENTION

In certain endeavors, such as golf, it is important to keep one's head fixed in relation to a separate object, e.g., a golf ball. The present invention relates to an aid for achieving such proper head positioning.

Various prior art devices have been proposed as head positioning aids. Typically, however, such devices are impractical because they are complicated, relatively expensive, aesthetically unattractive, and often too heavy.

SUMMARY OF THE INVENTION

The deficiencies of prior art devices are overcome by the present invention which provides a head positioning aid comprising a conventional visor portion of a cap or sun visor which has a pair of spaced, substantially parallel markings located on the underside of the visor. The markings are lines substantially equidistant from, and parallel to, an axis which bisects the visor from back to front. The spacing between the markings is approximately equal to that between the eyes of the user.

DETAILED DESCRIPTION OF THE INVENTION

The present invention now will be described in greater detail with respect to the accompanying drawings wherein:

FIG. 1 is a bottom plan view of the underside of a visor incorporating the present invention;

FIG. 2 is a bottom plan view of the underside of a sun visor incorporating the present invention;

FIG. 3 is a rear perspective view of the sun visor shown in FIG. 2, a portion thereof being omitted for convenience of illustration.

Figure 4A:
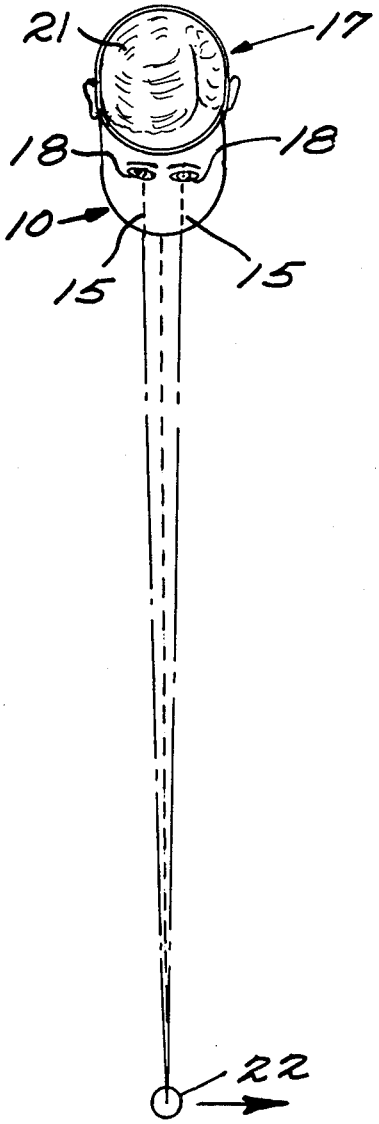
FIGS. 4A and 4B are top plan views of the present invention illustrating its use as a head positioning aid, FIG. 4A representing proper head position with respect to an object and FIG. 4B representing improper position of the head.

Referring to FIG. 1, a visor 10 is illustrated with its underside 12, from the back edge 13 to the front edge 14, being provided with substantially parallel straight line markings 15 symmetrically positioned on opposite sides of an axis 16 bisecting the visor. The distance (d) between the ends of the markings adjacent edge 13 of the visor approximates the spacing between the eyes of the user. A typical spacing is approximately 6 cm.

In FIG. 2, the visor 10 is shown in attachment with a conventional adjustable headband 17 to form a sun visor.

FIG. 3 illustrates the sun visor of FIG. 2 such that the two markings 15 can be seen on the underside 12 of the visor.

Figure 4B:
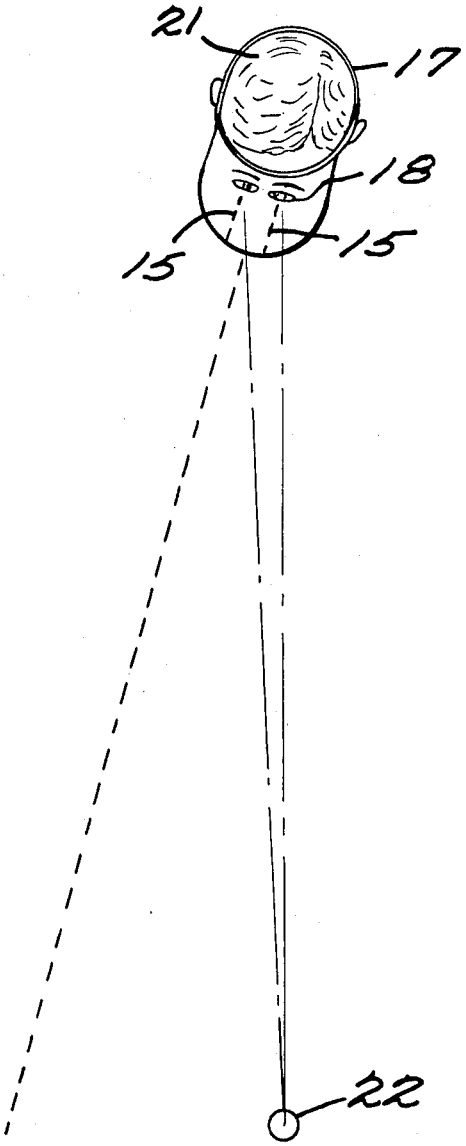

FIGS. 4A and 4B illustrate the head 21 and eyes 18 (hidden) of a user of a sun visor according to FIGS. 2 and 3 as the user orients his head with respect to an object 22, such as a golf ball.

In operation, the user places the visor on his head, closes a first eye and then aligns the marking adjacent the second eye with the object 22. When the first eye is opened, the head will be in correct position. This occurs, when such a procedure is followed, because the markings 15 appear to converge at the front edge 14 of the visor 10. In other words, by directing the point of convergence of lines 15 at the object 22 (as shown by the dotted line in FIG. 2A), the user properly positions his head relative to the object. Conversely, when the user recognizes that the point of convergence is not directed towards object 22, he knows that his head is not properly positioned (FIG. 4B).

Relating the present invention to playing golf, for example, the user knows throughout his stroke that so long as the convergence of lines 15 is pointed towards the ball, his head is in correct position. This is especially beneficial for putts where contact at an intended spot on the ball is most important.

By providing the positioning lines integrally with the visor, the present invention has many practical advantages as compared with the prior art. First, it is much simpler and easier to use. Instead of joining mechanical parts to the visor and then having to adjust and/or lock the parts in place, the present invention is ready to use when the visor is placed on the head. Additionally, it is much less expensive because no mechanical parts are required. Still further, by the elimination of attachments to the visor, the present invention is much lighter on the user's head. Finally, the invention is more aesthetically pleasing than previously known devices because it does not require securing mechanical arms or wires to the visor.

The foregoing disclosure and illustrations of the invention are exemplary thereof and apply to any activity which requires steadiness and proper head positioning, for example, archery. Various changes in the size, shape and materials, as well as in the details of the illustrated construction, may be made within the scope of the appended claims without departing from the spirit of the invention. For example, the visor may be made of opaque or translucent material. Furthermore, instead of being joined to a headband, the visor may constitute a portion of other types of headpieces, such as a conventional cap.

What is claimed is:

1. A device adapted to be worn on a person's head as an aid to positioning the head relative to a remote object, said device comprising:

a visor having front and back edges and an underside, said visor being attached at its back edge to a headpiece; and a pair of spaced lines applied to the underside of the visor, said lines being substantially symmetrically positioned on opposite sides of an axis extending between said front and back edges and bisecting the visor, the spacing between said lines corresponding to the normal separation between a person's eyes.

2. A device according to claim 1, wherein said lines are substantially parallel.

3. A device according to either of claims 1 or 2, wherein said distance between the lines is 6 cm.

4. A device according to either claim 1 or claim 2, wherein said visor is translucent.

5. A device according to either claim 1 or claim 2, wherein said headpiece is a headband.

6. A device according to either claim 1 or claim 2 wherein said headpiece is a cap.

* * * * *